US005334480A

United States Patent [19]

Inaba et al.

[11] Patent Number: 5,334,480

[45] Date of Patent: Aug. 2, 1994

[54] CAPSULE TONER

[75] Inventors: Yoshihiro Inaba; Koichi Takashima; Izuru Matsui; Tsutomu Kubo, all of Minami-Ashigara, Japan

[73] Assignee: Fuji Xerox Co., Ltd., Tokyo, Japan

[21] Appl. No.: 991,360

[22] Filed: Dec. 15, 1992

[30] Foreign Application Priority Data

Dec. 19, 1991 [JP] Japan ..... 3-354705

[51] Int. Cl.[5] ..... G03G 9/093

[52] U.S. Cl. ..... 430/138; 430/110

[58] Field of Search ..... 430/138, 110

[56] References Cited

U.S. PATENT DOCUMENTS

| | | | |
|---|---|---|---|
| 4,621,039 | 11/1986 | Ciccarelli et al. | 430/110 |
| 4,840,863 | 6/1989 | Otsu et al. | 430/110 |
| 5,215,851 | 6/1993 | Tomita et al. | 430/138 |

FOREIGN PATENT DOCUMENTS

| | | |
|---|---|---|
| 58-145964 | 8/1983 | Japan . |
| 59-185353 | 10/1984 | Japan . |
| 59-187357 | 10/1984 | Japan . |
| 62-227162 | 10/1987 | Japan . |
| 63-16337 | 1/1988 | Japan . |

OTHER PUBLICATIONS

Inchalik, E. J. and G. Rubin, "Plasticizers", 1975–1976 *Modern Plastics Encyclopedia,* pp. 226–228 and pp. 692–702.

*Primary Examiner*—John Goodrow

*Attorney, Agent, or Firm*—Oliff & Berridge

[57] ABSTRACT

A capsule toner comprising a core covered with an outer shell, the outer shell comprising a substance capable of forming a radical, a polymer comprising at least a unit derived from a quaternary ammonium salt-containing vinyl monomer represented by formula (I) being deposited on the surface of the outer shell, and basic carbon black being externally added to the capsule toner:

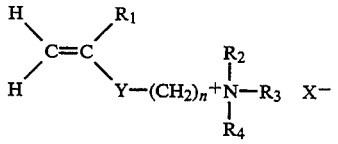

(I)

wherein $R_1$ represents a hydrogen atom or a methyl group; $R_2$, $R_3$, and $R_4$ each represents a hydrogen atom, an alkyl group having 1 to 5 carbon atoms or a benzyl group; Y represents —COO—, —CONH— or a phenylene group; n represents an integer of from 1 to 7; and $X^-$ represents a halogen ion or an anion having a $—COO^-$ group or an $—SO_3^-$ group.

6 Claims, No Drawings

CAPSULE TONER

FIELD OF THE INVENTION

This invention relates to a toner for developing an electrostatic latent image in electrophotography and electrostatic printing, and more particularly to a microcapsule toner.

BACKGROUND OF THE INVENTION

There have been conventionally known toners containing a quaternary ammonium salt to improve development characteristics. For the charge control of conventional toners, JP-A-59-185353 (the term "JP-A" as used herein means an "unexamined published Japanese patent application"), JP-A-59-187357 and JP-A-62-227162 disclose capsule toners wherein a specific quaternary ammonium salt polymer is contained in the outer shell of the capsule, and capsule toner wherein a specific polymer having an amino group is contained in the outer shell of the capsule.

However, the above conventional capsule toners have disadvantages in that the environment dependence, particularly humidity dependence of chargeability is poor and a failure in charging is liable to be caused. Further, since the polymer is contained as a constituent component of the outer shell of the capsule, it is difficult to obtain a toner having satisfactory properties in both mechanical strength and chargeability. Hence, there is a disadvantage in that a degree of freedom of the choice of materials is narrow. JP-A-62-22716 discloses a capsule toner wherein a specific polymer having an amino group is contained in the outer shell of the toner. However, the polymer has a disadvantage in that the properties of photoreceptors are changed, although chargeability and the environment dependence of chargeability are improved.

The present invention has been accomplished with a view to eliminate the above-mentioned disadvantages.

SUMMARY OF THE INVENTION

An object of the present invention is to provide a positively chargeable capsule toner which does not cause the change of the properties of the photoreceptors and has charging properties which are little dependent on environmental conditions and which has a sharp charge distribution, is excellent in mechanical strength and has a wide degree of freedom of the choice of materials.

Other objects and effects of the present invention will be apparent from the following description.

The present invention relates to a capsule toner comprising a core covered with an outer shell of a resin, the outer shell comprising a substance capable of forming a radical, a polymer comprising at least a unit derived from a quaternary ammonium salt-containing vinyl monomer represented by formula (I) being deposited on the surface of the outer shell, basic carbon black being externally added to the capsule toner:

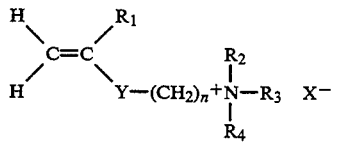

(I)

wherein $R_1$ represents a hydrogen atom or a methyl group; $R_2$, $R_3$, and $R_4$ each represents a hydrogen atom, an alkyl group having from 1 to 5 carbon atoms or a benzyl group; Y represents —COO—, —CONH— or a phenylene group; n represents an integer of from 1 to 7; and $X^-$ represents a halogen ion or an anion having a —COO—, group or an $—SO_3^-$ group.

DETAILED DESCRIPTION OF THE INVENTION

The capsule toner of the present invention has a capsule structure comprising a core and an outer shell with which the core is covered, wherein the outer shell has at least a substance capable of forming a radical on the surface thereof.

The term "substance capable of forming a radical" as used herein refers to a substance which undergoes a hydrogen attraction or addition reaction with a monomer radical or cerium (IV) ion to generate a radical.

Specific examples of the substance include polymers such as polyamide, polyurea, polyurethane, polyester, polyvinyl acetate, polyvinyl alcohol, cellulose, synthetic rubber, polystyrene, styrene-(meth)acrylic copolymers, epoxy resins, phenoxy resin, acrylic resins, and mixtures thereof.

The capsule particles of the present invention have the substance capable of forming a radical on the surfaces thereof. The substance capable of forming a radical is uniformly present or uniformly scattered on the surface of the outer shell.

Examples of resins which can be preferably used to form the outer shell in the present invention include a polyurea resin, a polyurethane resin, a polyamide resin, a polyester resin, an epoxy resin, an epoxy urea resin, an epoxy urethane resin, and a mixture thereof. Particularly preferred include a polyurea resin, a polyurethane resin, a mixture of a polyurea resin and a polyurethane resin, an epoxy urea resin, an epoxy urethane resin, and a mixture of an epoxy urea resin and an epoxy urethane resin.

The polymer to be deposited on the surfaces of the capsule particles having at least the substance capable of forming a radical on the surfaces thereof, will be illustrated below.

The amount of the polymer deposited on the surface of the capsule particles is generally from 0.1 to 50% by weight, preferably from 0.5 to 10% by weight, based on the weight of the capsule particles.

The polymer may be deposited on the surface of the outer shell of the capsule (on the surfaces of the capsule particles) through physical bonding or chemical bonding. However, chemical bonding is preferred from the viewpoint of durability.

As examples of the physical bonding, the polymer is dissolved in an appropriate solvent, and the resulting solution is spray-dried together with the capsule particles; or the polymer is mixed with the capsule particles, and heat and pressure are applied to the resulting mixture to perform powder melting coating. As examples of the chemical bonding, the polymer is graft-polymerized on the surface of the capsule particles. In the case of graft-polymerization, the quaternary ammonium salt-containing vinyl monomer and an appropriate polymerization initiator are added to the capsule particles and the polymerization is performed on the surface of the capsule particles.

The polymer to be deposited on the surface of the outer shell comprises at least a unit derived from a quaternary ammonium salt-containing vinyl monomer represented by formula (I). Examples of the cation moiety of the monomer include those represented by the following formulae (1) to (6).

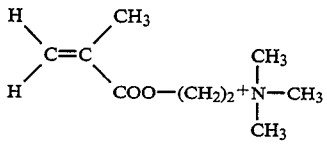

(1)

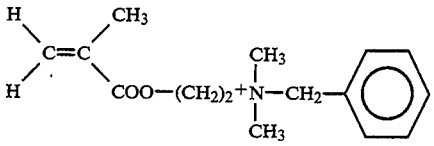

(2)

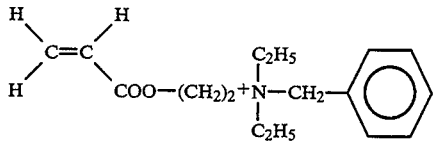

(3)

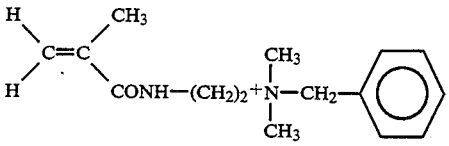

(4)

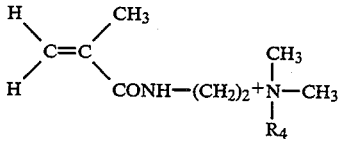

(5)

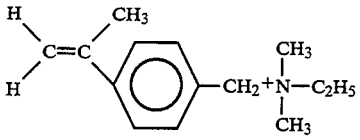

(6)

Among the above, cation moieties represented by formulae (1), (2), (4) and (5) are preferred, and those represented by formulae (1) and (2) are more preferred.

Examples of the anion moiety $X^-$ include halogen ions such as $Cl^-$, $Br^-$, $I^-$, aliphatic carboxyl groups such as $CH_3COO^-$, $C_2H_5COO^-$, $C_3H_7COO^-$, $C_7H_{15}COO^-$, $C_{11}H_{23}COO^-$, aromatic carboxyl groups such as

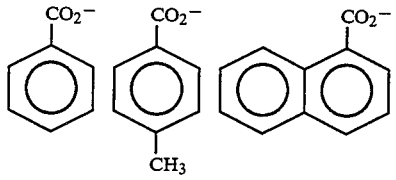

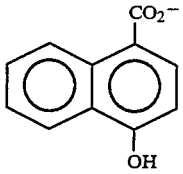

aliphatic sulfo groups such as $CH_3SO_3^-$, $C_2H_5SO_3^-$, $C_3H_7SO_3^-$, $C_7H_{15}SO_3^-$, $C_{11}H_{23}SO_3^-$, and aromatic sulfo groups such as

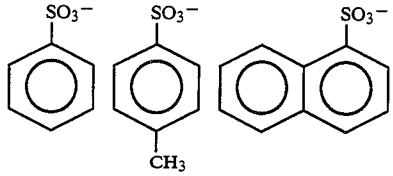

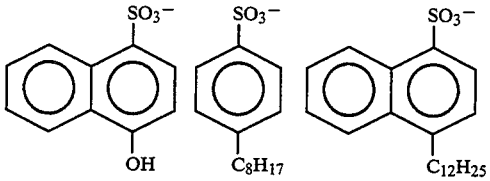

The anion moiety may be an anion residual group of an acid dye such as Acid Red, Acid Orange, Acid Violet or Acid Blue.

Among the above, an aromatic sulfo group is preferred, and an aromatic sulfo group having a hydroxyl group is more preferred.

The polymer of the present invention may comprise the monomer of formula (I) alone. The polymer may be a copolymer obtained by using the monomer of formula (I) as one component. When the monomer of formula (I) is used as one component of the copolymer, the content of the monomer is generally from 1 to 80 mol%, preferably from 5 to 60 mol%, based on the total amount of the polymer.

Examples of comonomers copolymerizable with the monomer of formula (I) include (meth)acrylic acid; (meth)acrylic esters such as methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate and phenyl (meth)acrylate; aliphatic vinyl esters such as vinyl formate, vinyl acetate, vinyl propionate, vinyl butyrate, vinyl trimethylacetate, vinyl caproate, vinyl caprylate and vinyl stearate; vinyl ethers such as ethyl vinyl ether, propyl vinyl ether, butyl vinyl ether, hexyl vinyl ether, 2-ethylhexyl vinyl ether and phenyl vinyl ether; vinyl ketones such as methyl vinyl ketone and phenyl vinyl ketone; and aromatic vinyl compounds such as styrene, chlorostyrene, hydroxystyrene and $\alpha$-methylstyrene. One or more of these comonomers may be copolymerized with the monomer of formula (I). Among them, (meth)acrylic esters are particularly preferred.

The terms "(meth)acrylic" and "(meth)acrylate" used herein mean "acrylic or methacrylic" and "acrylate or methacrylate", respectively.

The term "basic carbon black" as used herein refers to carbon black having a pH of not lower than 7, preferably not lower than 7.5. The pH is a value obtained by boiling 10 g of carbon black in 100 g of distilled water for 2 hours, allowing the mixture to stand to thereby cooled to room temperature, removing the supernatant liquid and measuring the pH of the resulting paste with a pH meter.

The carbon black generally has a particle diameter of 10 to 100 m$\mu$, preferably 20 to 60 m$\mu$, in an average arithmetically determined from electron microscope photograph. Specific examples of the carbon black include REGAL 300R, REGAL 330, REGAL 330R, REGAL 500R, ELFTEX 8 and ELFTEX 12 (manufactured by Cabot). The carbon black is generally used in an amount of from 0.01 to 10% by weight, preferably from 0.05 to 5% by weight, based on the amount of the toner.

The core material of the capsule toner particles generally comprises a pressure fixable component as a main component for pressure fixing, or a heat fixable component as a main component for heat fixing. For pressure fixing, a core material comprising a binder resin, a high-boiling point solvent for dissolving the binder resin and a colorant, and a core material comprising a soft solid material and a colorant are particularly preferred. If desired, the colorant may be replaced with magnetic powder, or additives such as a silicone oil may be added to improve fixing properties. A high-boiling point solvent incapable of dissolving the binder resin may be optionally used in combination with the high-boiling point solvent capable of dissolving the binder resin. It is desirable that the types and composition ratio of the constituent components of the core material for heat fixing are properly changed from those of the constituent components of the core material for pressure fixing.

Any of conventional fixing resins can be used as the binder resin. Examples of the binder resin include acrylic ester polymers such as polymethyl acrylate, polyethyl acrylate, polybutyl acrylate, poly-2-ethylhexyl acrylate and polylauryl acrylate; methacrylic ester polymers such as polymethyl methacrylate, polybutyl methacrylate, polyhexyl methacrylate, poly-2-ethylhexyl methacrylate and polylauryl methacrylate; copolymers of a styrene monomer and an acrylic ester or methacrylic ester; polyvinyl acetate; polyvinyl propionate; polyvinyl butyrate; ethylenic polymers such as polyethylene and polypropylene and ethylenic copolymers; styrene copolymers such as a styrene/butadiene copolymer, a styrene/isoprene copolymer and a styrene/maleic acid copolymer; polyvinyl ether, polyvinyl ketone, polyester, polyamide, polyurethane, rubber, epoxy resin, polyvinyl butyral, rosin, modified resin, terpene resin and phenolic resin. These compounds may be used either alone or as a mixture of two or more of them. The binder resins may be formed by feeding monomers and then polymerizing them after encapsulation.

Any of oily solvents having a boiling point of not lower than 140° C., preferably not lower than 160° C. can be used as the high-boiling point solvent capable of dissolving the binder resin. Such solvents can be chosen, for example, from among those described in *Modern Plastics Encyclopedia,* Chapter of "Plasticizer" (1975–1976), or high-solvents described as the core materials of capsule toners for pressure fixing as disclosed in JP-A-58-145964 and JP-A-63-16337.

Specific examples of the high-boiling point solvent include phthalic esters (e.g., diethyl phthalate, dibutyl phthalate), aliphatic dicarboxylic acid esters (e.g., diethyl malonate, dimethyl oxalate), phosphoric esters (e.g., tricresyl phosphate, trixylyl phosphate), citric esters (e.g., o-acetyl-triethyl citrate), benzoic esters (e.g., butyl benzoate, hexyl benzoate), fatty acid esters (e.g., hexadecyl myristate, dioctyl adipate), alkylnaphthalenes (e.g., methylnaphthalene, dimethyl-naphthalene, monoisopropylnaphthalene, diisopropyl-naphthalene), alkyldiphenyl ethers (e.g., o-, m- or p-methyldiphenyl ether), amide compounds of higher fatty acids or aromatic sulfonic acids (e.g., N,N-dimethyl-lauroamide, N-butylbenzenesulfonamide), trimellitic acid esters (e.g., trioctyl trimellitate), diarylalkanes (e.g., diarylmethane such as dimethyldiphenylmethane and diarylethane such as 1-phenyl-l-methylphenylethane, 1-dimethylphenyl-1-phenylethane, 1-ethylphenyl-1-phenylethane), and chlorinated paraffins. Further, aliphatic saturated hydrocarbons or organic solvents mainly comprising an aliphatic saturated hydrocarbon (e.g., Isopar-G, Isopar-H, Isopar-L, Isopar-M manufactured by Exxon Company) can be used when polymers having a long-chain alkyl group such as lauryl methacrylate homopolymer or copolymers thereof are used as binder polymers.

Examples of the colorants include inorganic pigments such as carbon black, red oxide, Prussin blue and titanium oxide; azo pigments such as Fast Yellow, Disazo Yellow, pyrazolone red, Chelate Red, Brilliant Carmine and Para Brown; phthalocyanine pigments such as copper phthalocyanine and metal-free phthalocyanine; and condensed polycyclic pigments such as flavanthrone yellow, dibromoanthrone orange, perylene red, quinacridone red and dioxazine violet. Further, disperse dyes and oil-soluble dyes can be used.

A part or the whole of the black colorant can be replaced with magnetic powder to form a magnetic one-component toner. Examples of magnetic powder include magnetite, ferrite, metals (e.g., cobalt, iron, nickel) and alloys thereof.

Further, a colorant or magnetic powder charged as a component of the core may be present at the interface between the core and the outer shell or in the outer shell after encapsulation.

Any of materials having flexibility at room temperature and fixability can be used as the soft solid material, and polymers having a Tg of from −60° C. to 5° C. and mixtures of such a polymer with other polymers are preferred. The soft solid material as one component of the core material can be enclosed in the capsule, for example, by using a method wherein the material in the form of a polymer together with other components for the core, a low-boiling point solvent and a shell-forming component is charged, and the low-boiling point solvent is expelled to form a core simultaneously with the formation of a shell by interfacial polymerization or after completion of the formation of the shell. Alternatively, the soft solid material in the form of a monomer or monomers is charged, a shell is formed by interfacial polymerization, and then the monomer or monomers are polymerized to loren a core.

The present invention is now illustrated in greater detail with reference to Examples, but it should be understood that the present invention is not deemed to be limited thereto. All parts, percents and the like used herein are in terms of by weight unless otherwise indicated.

EXAMPLE 1

Preparation of capsule particles

In a mixed solvent composed of 60 g of an aliphatic saturated hydrocarbon ("Isopar-M" manufactured by Exxon Company) and 60 g of ethyl acetate, 30 g of a lauryl methacrylate polymer (Mw: $3\times10^4$) and 40 g of a lauryl methacrylate/n-butyl copolymer (Mw: $6\times10^4$) were dissolved. To the resulting solution, 120 g of magnetic powder ("EPT-1000" manufactured by Toda Kogyo K.K.) was added, and the mixture was dispersed in a ball mill for 16 hours. To 200 g of the resulting dispersion, 30 g of an isocyanate ("Sumidur L" manufactured by Sumitomo Bayer Urethane K.K.) and 24 g of ethyl acetate were added, followed by thoroughly mixing. The resulting dispersion was referred to as Composition A. Separately, 10 g of hydroxypropylmethyl cellulose ("Metolose 65SH50" manufactured by Shin-Etsu Chemical Co., Ltd.) was dissolved in 200 g of ion-exchanged water, and the resulting solution was cooled to 5° C. The resulting solution was referred to as Composition B. While Composition B was stirred in an emulsifier ("Auto homomixer" manufactured by Shuki Kako K.K.), Composition A was slowly added thereto to thereby carry out emulsification. An O/W emulsion composed of oil droplet particles having an average particle size of about 12 μm dispersed in the emulsion was obtained.

The emulsifier was then replaced with a stirrer provided with propeller agitating blade ("Three-One Motor" manufactured by Shinto Kagaku K.K.), and the emulsion was stirred at 400 rpm. After 10 minutes, 100 g of a 5% aqueous solution of diethylenetriamine was added dropwise thereto. After completion of the dropwise addition, the mixture was heated to 60° C., and an encapsulation reaction was carried out for 3 hours. After completion of the reaction, the reaction mixture was poured into 2 l of ion-exchanged water, and the mixture was thoroughly stirred and then left to stand. After capsule particles settled, the supernatant liquid was removed. This operation was repeated further 7 times to wash the capsule particles with ion-exchanged water. Capsule particles containing an oil binder were thus obtained. Ion-exchanged water was added to the capsule particles to prepare a suspension having a solid content of 40%.

Preparation of toner

To 125 g (corresponding to 50 g of capsule particles) of the capsule suspension prepared above, 125 g of ion-exchanged water was added, and the mixture was stirred in a stirrer provided with propeller agitating blade ("Three-One Motor" manufactured by Shinto Kagaku K.K.) at 200 rpm. Five grams of 1N nitric acid and 4 g of a 10% aqueous solution of cerium sulfate were added thereto, and 0.5 g of ethylene glycol dimethacrylate was then added thereto. The mixture was reacted at 15° C. for 3 hours. After completion of the reaction, the reaction mixture was poured into one liter of ion-exchanged water, and the mixture was thoroughly stirred and then left to stand. After the capsule particles settled, the supernatant liquid was removed. This operation was repeated further twice to wash the capsule particles with ion-exchanged water. There were obtained the capsule particles wherein ethylene glycol dimethacrylate was graft-polymerized onto the surface of the outer shell of the capsule.

The resulting capsule particles were again suspended in ion-exchanged water, and the suspension was stirred in a stirrer provided with propeller agitating blade ("Three-One Motor" manufactured by Shinto Kagaku K.K.) at 200 rpm. To the suspension, 0.4 g of potassium persulfate, 0.2 g of chloride of Compound (1) exemplified above, 2.0 g of methyl methacrylate, and 0.16 g of sodium hydrogensulfite were successively added. The mixture was reacted at 25° C. for 3 hours. After completion of the reaction, the reaction mixture was poured into 2 l of ion-exchanged water, and the mixture was thoroughly stirred and then left to stand. After the capsule particles settled, the supernatant liquid was removed. This operation was repeated further 4 times to wash the capsule particles with ion-exchanged water.

Two grams of a 5% aqueous solution of sodium 4-naphtholsulfonate was added to the suspension of the capsule particles, and the mixture was stirred at room temperature for 30 minutes to carry out an ion-exchange reaction. After completion of the reaction, the capsule particles were washed with one liter of ion-exchanged water 5 times to obtain a capsule toner. The resulting suspension of capsule toner was spread in a vat made of stainless steel and dried in a drier (manufactured by Yamato Kagaku K.K.) at 60° C. for 10 hours. To 100 parts of the resulting capsule toner, 0.1 part of basic carbon black (pH: 8.5, "REGAL 330R" manufactured by Cabot Co.) was added, followed by thoroughly mixed to obtain a capsule toner according to the present invention.

Three grams of the capsule toner obtained above and 100 g of an iron powder carrier having a surface coated with a phenolic resin were mixed in an atmosphere of 20° C. and 50% RH. The quantity of charge of the capsule toner was found to be +23 μC/g as measured by a blow-off method. The charge distribution of the toner was examined, and it was found that the amount of toner oppositely charged was 5% based on the total amount of the toner.

Separately, when the mixing of the capsule toner and the carrier was conducted in an atmosphere of 28° C. and 80% RH, the quantity of charge of the capsule toner was found to be +20 μC/g as measured by the blow-off method. The charge distribution of the toner was examined, and it was found that the amount of toner oppositely charged was 10% based on the total amount of the toner.

The evaluation to image quality was made under high temperature and humidity conditions at 28° C. and 85% RH by obtaining copy sumples using a copying machine ("2700" manufactured by Fuji Xerox Co., Ltd., and modified for capsule toners). It was found that 20,000 copies free from fog could be stably obtained. It was also found that the properties of the photoreceptor were not changed.

COMPARATIVE EXAMPLE 1

A capsule toner for comparison was prepared in the same manner as in Example 1 except that acidic carbon black (pH: 3.0, "MOGUL-L" manufactured by Cabot Co-) was used in place of the basic carbon black ("REGAL 330R" manufactured by Cabot Co.).

Three grams of the resulting capsule toner and 100 g of an iron powder carrier having a surface coated with a phenolic resin were mixed in an atmosphere of 20° C. and 50%RH. The quantity of charge of the capsule toner was found to be +20 μC/g as measured by the blow-off method. The charge distribution was examined, and it was found that the amount of toner oppositely charged was 30% based on the total amount of the toner.

Separately, when the mixing of the capsule toner and the carrier was conducted in an atmosphere of 28° C. and 80%, the quantity of charge of the capsule toner was found to be +10 μC/g as measured by the blow-off method. The charge distribution was examined, and it was found that the amount of toner oppositely charged was 40% based on the total amount of the toner.

The evaluation of image quality was made under high temperature and humidity conditions at 28° C. and 85% RH in the same manner as in Example 1. The first copy suffered from fog, and the 100th copy had a reduced image density and an image quality which was very poor in clearness.

EXAMPLE 2

To 125 g (corresponding to 50 g of the capsule particles) of the suspension of the capsule particles prepared in Example 1, 125 g of ion-exchanged water was added. The mixture was stirred in a stirrer provided with propeller agitating blade ("Three-One Motor" manufactured by Shinto Kagaku K.K.) at 200 rpm. Five grams of 1N nitric acid and 4 g of a 10% aqueous solution of cerium sulfate were added thereto, and 0.5 g of ethylene glycol .dimethacrylate was then added thereto. The mixture was reacted at 15° C. for 3 hours. After completion of the reaction, the reaction mixture was poured into one liter of ion-exchanged water, and the mixture was thoroughly stirred and then left to stand. After capsule particles settled, the supernatant liquid was removed. This operation was repeated further twice to wash the capsule particles with ion-exchanged water. There were obtained the capsule particles wherein ethylene glycol dimethacrylate was graft-polymerized onto the surface of the outer shell of the capsule.

The capsule particles were again suspended in ion-exchanged water, and the suspension was stirred in a stirrer provided with propeller agitating blade ("Three-One Motor" manufactured by Shinto Kagaku K.K.) at 200 rpm. To the suspension, 0.4 g of potassium persulfate, 0.2 g of chloride of Compound (2) exemplified above, 2.0 g of methyl methacrylate, and 0.16 g of sodium hydrogensulfite were successively added. The mixture was reacted at 25° C. for 3 hours. After completion of the reaction, the reaction mixture was poured into 2 l of ion-exchanged water, and the mixture was thoroughly stirred and then left to stand. After the capsule particles settled, the supernatant liquid was removed. This operation was repeated 4 more times to wash the capsule particles with ion-exchanged water. To the suspension of the capsule particles, 2 g of a 5% aqueous solution of Fast Red A (acid dye manufactured by Wako Pure Chemicals Industries, Ltd.) was added. The mixture was stirred at room temperature for 30 minutes to carry out an ion-exchange reaction. After completion of the reaction, the capsule particles were washed with one liter of ion-exchanged water 5 times to obtain a capsule toner. The resulting suspension of capsule toner was spread in a vat made of stainless steel and dried in a drier (manufactured by Yamato Kagaku K.K.) at 60° C. for 10 hours. To 100 parts of the resulting capsule toner, 0.1 part of basic carbon black (pH: 8.5, "REGAL 330R" manufactured by Cabot Co-) was added, followed by thoroughly mixed to obtain a capsule toner according to the present invention.

Three grams of the capsule toner prepared above and 100 g of an iron powder carrier having a surface coated with a phenolic resin were mixed in an atmosphere of 20° C. and 50% RH. The quantity of charge of the toner was found to be +23 μC/g as measured by the blow-off method. The charge distribution of the toner was examined, and it was found that the amount of toner oppositely charged was 5% on the total amount of the toner.

Separately, when the mixing of the capsule toner and the carrier was conducted in an atmosphere of 28° C. and 80% RH, the quantity of charge of the capsule toner was found to be +20 μC/g as measured by the blow-off method. The charge distribution of the toner was examined, and it was found that the amount of toner oppositely charged was 10% based on the total amount of the toner.

The evaluation of image quality was made under high temperature and humidity conditions at 28° C. and 85% RH by obtaining copy samples using a copying machine ("2700" manufactured by Fuji Xerox Co., Ltd. and modified for the capsule toner). It was found that 20,000 copies free from fog could be stably obtained. It was also found that the properties of the photoreceptor was not changed.

COMPARATIVE EXAMPLE 2

A capsule toner for comparison was prepared in the same manner as in Example 2 except that acidic carbon black (pH: 3.0, "MOGUL-L" manufactured by Cabot Co.) was used in place of the basic carbon black ("REGAL 330R" manufactured by Cabot Co.).

Three grams of the resulting capsule toner and 100 g of an iron powder carrier having a surface coated with a phenolic resin were mixed in an atmosphere of 20° C. and 50% RH. The quantity of charge of the toner was found to be +20 μC/g as measured by the blow-off method. The charge distribution of the toner was examined, and it was found that the amount of toner oppositely charged was 25% based on the total amount of the toner.

Separately, when the mixing of the capsule toner and the carrier was conducted in an atmosphere of 28° C. and 80% RH, the quantity of charge of the capsule toner was found to be +12 μC/g as measured by the blow-off method. The charge distribution was examined, and it was found that the amount of toner oppositely charged was 30% based on the total amount of the toner.

The evaluation of image quality was made under high temperature and humidity conditions at 28° C. and 85% RH in the same manner as in Example 2. The first copy suffered from fog, and the 100th copy had a reduced image density and an image quality which was very poor in clearness.

It will be understood from the above disclosure that when a specific quaternary ammonium salt-containing polymer is deposited on the outer shell of the capsule, the properties of the photoreceptor can be prevented from being changed, and when basic carbon black is externally added, the environment dependence of chargeability can be improved and the charge distribution can be made sharp. Because the mechanical strength and the chargeability of the capsule toner each can be separately controlled, the toner having a high mechanical strength as well as excellent charging characteristics can be obtained and images of good quality can be stably obtained when copying is conducted over a period of time.

While the invention has been described in detail and with reference to specific examples thereof, it will be apparent to one skilled in the art that various changes and modifications can be made therein without departing from the spirit and scope thereof.

What is claimed is:

1. A capsule toner comprising a core covered with an outer shell, said outer shell comprising a substance capable of forming a radical, a polymer comprising at least a unit derived from a quaternary ammonium salt-containing vinyl monomer represented by formula (I) being deposited on the surface of said outer shell, and basic carbon black being externally added to said capsule toner:

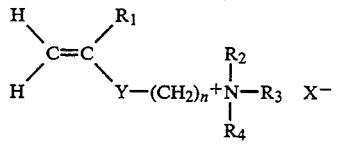

(I)

wherein $R_1$ represents a hydrogen atom or a methyl group; $R_2$, $R_3$, and $R_4$ each represents a hydrogen atom, an alkyl group having 1 to 5 carbon atoms or a benzyl group; Y represents —COO—, —CONH— or a phenylene group; n represents an integer of from 1 to 7; and $X^-$ represents a halogen ion or an anion having a —COO—$^-$ group or an —$SO_3^-$ group.

2. A capsule toner as claimed in claim 1, wherein said polymer is chemically bonded to the surface of said outer shell.

3. The capsule toner as claimed in claim 1, wherein said outer shell comprises at least one selected from the group consisting of a polyurea resin, a polyurethane resin, a mixture of a polyurea resin and a polyurethane resin, an epoxy urea resin, an epoxy urethane resin, and a mixture of an epoxy urea resin and an epoxy urethane resin.

4. A capsule toner comprising a core covered with an outer shell, said outer shell comprising a substance capable of forming a radical, a polymer consisting of at least one unit of a polymerized quaternary ammonium salt-containing vinyl monomer represented by formula (I) being deposited on the surface of said outer shell, and basic carbon black being externally added to said capsule toner:

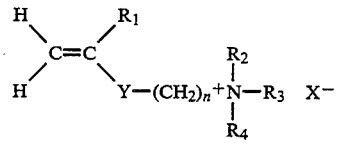

(I)

wherein $R_1$ represents a hydrogen atom or a methyl group; $R_2$, $R_3$, and $R_4$ each represents a hydrogen atom, an alkyl group having 1 to 5 carbon atoms or a benzyl group; Y represents —COO—, —CONH— or a phenylene group; n represents an integer of from 1 to 7; and $X^-$ represents a halogen ion or an anion having a —COO$^-$ group or an $-SO_3^-$ group.

5. A capsule toner comprising a core covered with an outer shell, said outer shell comprising a substance capable of forming a radical, a polymer consisting of at least one unit of a polymerized quaternary ammonium salt-containing vinyl monomer represented by formula (I) and at least one unit of a polymerized monomer selected from the group consisting of (meth)acrylic acids, (meth)acrylic esters, aliphatic vinyl esters, vinyl ethers, vinyl ketones, and aromatic vinyl compounds, being deposited on the surface of said outer shell, and basic carbon black being externally added to said capsule toner:

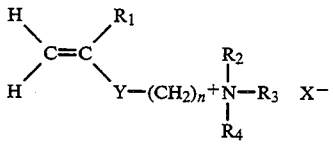

(I)

wherein $R_1$ represents a hydrogen atom or a methyl group; $R_2$, $R_3$, and $R_4$ each represents a hydrogen atom, an alkyl group having 1 to 5 carbon atoms or a benzyl group; Y represents —COO—, —CONH— or a phenylene group; n represents an integer of from 1 to 7; and $X^-$ represents a halogen ion or an anion having a —COO$^-$ group or an —$SO_3^-$ group.

6. A capsule toner as claimed in claim 5, wherein the (meth)acrylic esters are methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate or phenyl (meth)acrylate; the aliphatic vinyl esters are vinyl formate, vinyl acetate, vinyl propionate, vinyl butyrate, vinyl trimethylacetate, vinyl caproate, vinyl caprylate, or vinyl stearate; the vinyl ethers are ethyl vinyl ether, propyl vinyl ether, butyl vinyl ether, hexyl vinyl ether, 2-ethylhexyl vinyl ether, or phenyl vinyl ether; the vinyl ketones are methyl vinyl ketone or phenyl vinyl ketone; and the aromatic vinyl compounds are styrene, chlorostyrene, hydroxystyrene, or α-methylstyrene.

* * * * *